US008018169B2

(12) United States Patent
Jeong et al.

(10) Patent No.: US 8,018,169 B2
(45) Date of Patent: Sep. 13, 2011

(54) FIELD EMISSION DEVICE

(75) Inventors: Jin Woo Jeong, Daejeon (KR); Yoon Ho Song, Daejeon (KR); Dae Jun Kim, Daegu (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 530 days.

(21) Appl. No.: 12/279,284

(22) PCT Filed: Mar. 27, 2007

(86) PCT No.: PCT/KR2007/001487

§ 371 (c)(1),
(2), (4) Date: Aug. 13, 2008

(87) PCT Pub. No.: WO2007/114577

PCT Pub. Date: Oct. 11, 2007

(65) Prior Publication Data

US 2009/0058309 A1 Mar. 5, 2009

(30) Foreign Application Priority Data

Mar. 31, 2006 (KR) ..... 10-2006-0029454
Feb. 26, 2007 (KR) ..... 10-2007-0018871

(51) Int. Cl.
*H01J 1/30* (2006.01)
*H01J 1/304* (2006.01)

(52) U.S. Cl. ..... 315/169.3; 313/497; 313/308; 313/309

(58) Field of Classification Search ..... 315/169.3; 313/495–497, 308–311, 351, 346 R, 336
See application file for complete search history.

(56) References Cited

U.S. PATENT DOCUMENTS

| | | | | |
|---|---|---|---|---|
| 7,504,768 | B2 * | 3/2009 | Oh | 313/497 |
| 2005/0067938 | A1 | 3/2005 | Sheu et al. | |
| 2005/0116612 | A1 * | 6/2005 | Oh | 313/497 |
| 2005/0242704 | A1 | 11/2005 | Lee et al. | |

FOREIGN PATENT DOCUMENTS

| | | |
|---|---|---|
| JP | 06-052809 | 2/1994 |
| JP | 11-054023 | 2/1999 |
| KR | 1020060012405 | 2/2006 |

* cited by examiner

*Primary Examiner* — Daniel D Chang
(74) *Attorney, Agent, or Firm* — Rabin & Berdo, P.C.

(57) ABSTRACT

Disclosed is a field emission device. The field emission device includes: an anode substrate including an anode electrode formed on a surface thereof and a fluorescent layer formed on the anode electrode; a cathode substrate disposed opposite to and spaced apart from the anode substrate, and including at least one cathode electrode formed toward the anode substrate and a field emitter formed on each cathode electrode; and a gate substrate having one surface in contact with the cathode substrate, wherein the gate substrate include gate insulators surrounding the field emitters and having a plurality of openings exposing the field emitters, and a plurality of gate electrodes formed on the gate insulators around the openings and electrically isolated from one another. Thus, when the trajectories of the electron beams emitted from the emitters are rapidly changed over time by a voltage difference between the gate electrodes, an electron beam-scanned area can be expanded due to residual images and the electron beam can be more uniformly emitted due to an electron beam scattering effect and a linear beam spreading effect, resulting in improved emission uniformity of the fluorescent layer.

17 Claims, 18 Drawing Sheets

[Fig 1]
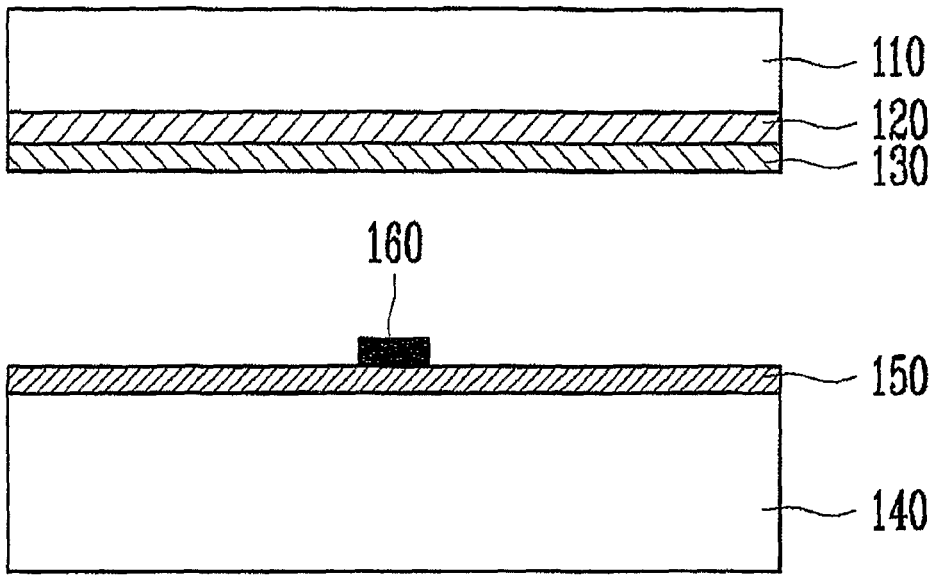
[Fig 2]
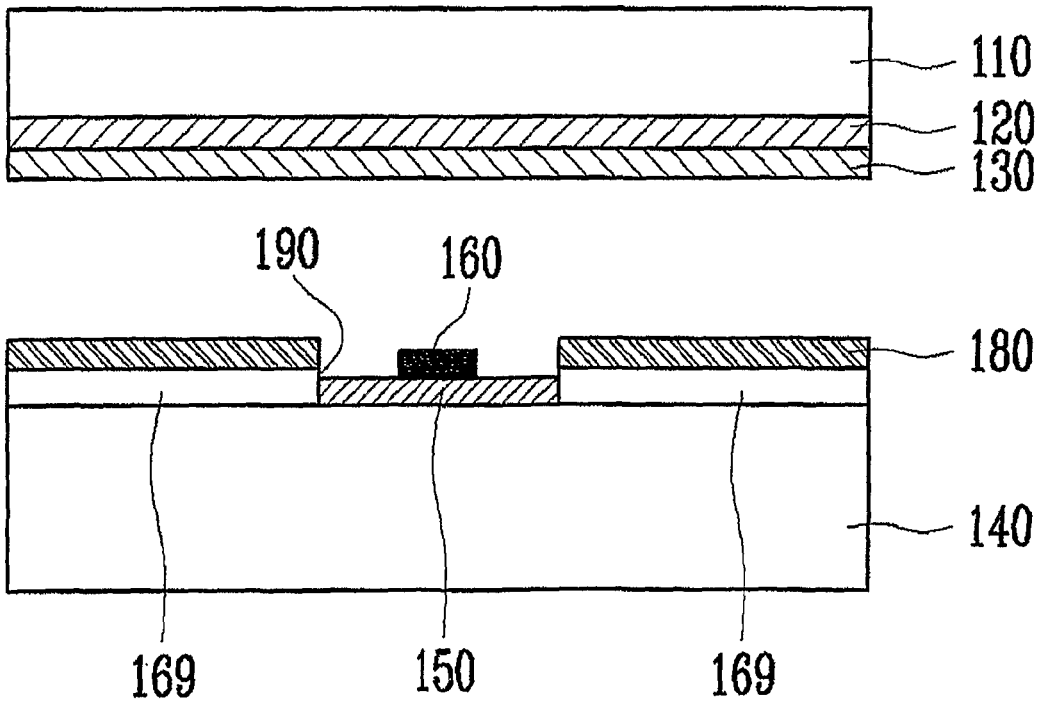

[Fig 3]
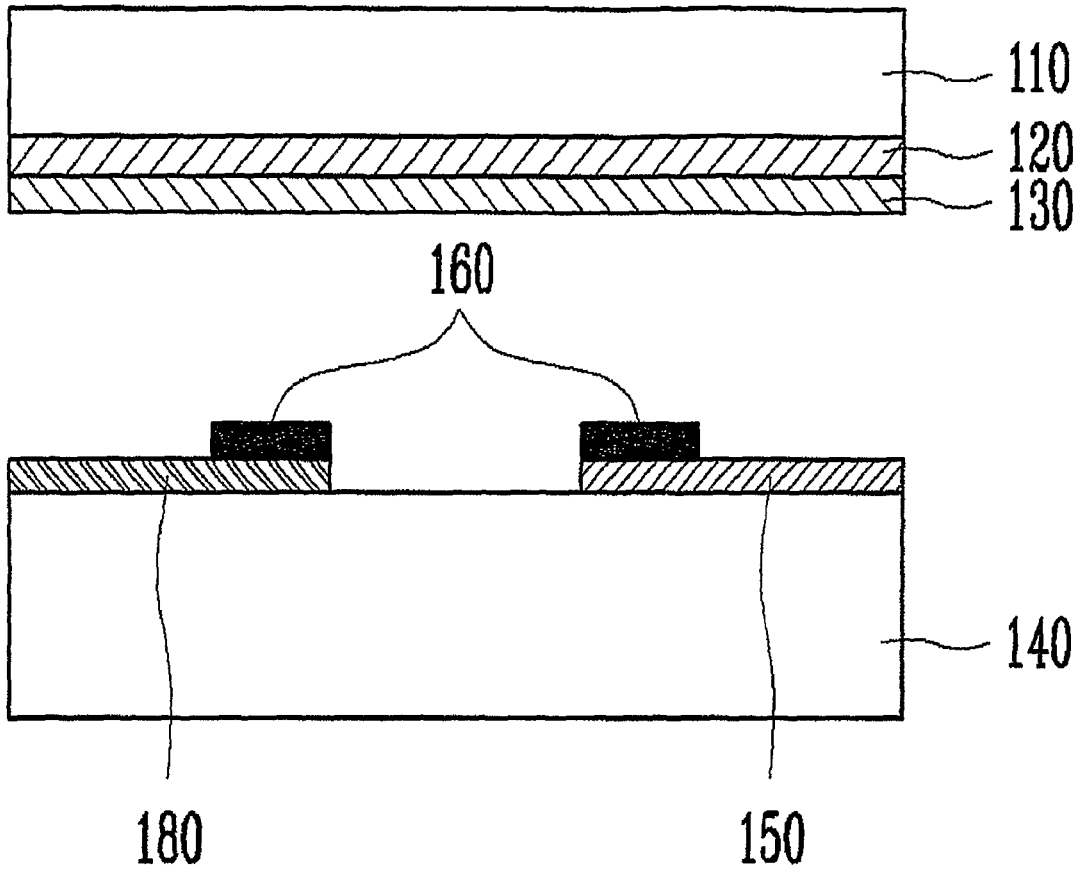

[Fig 4]
(a)
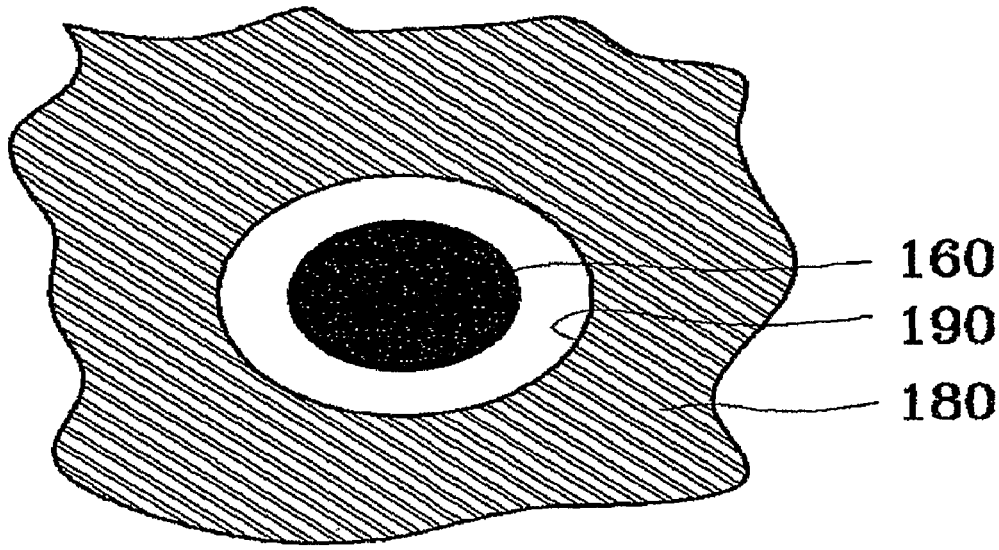
(b)
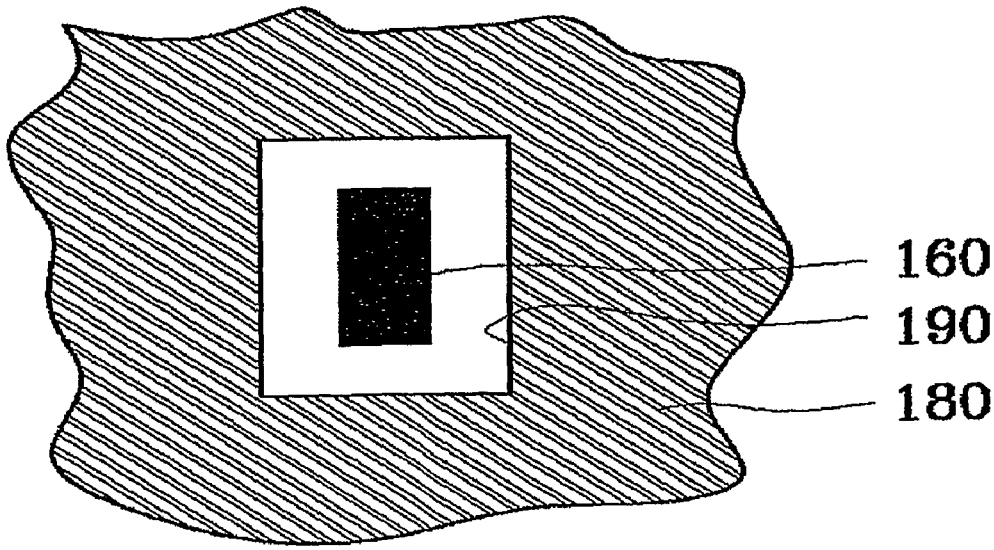

[Fig 5]
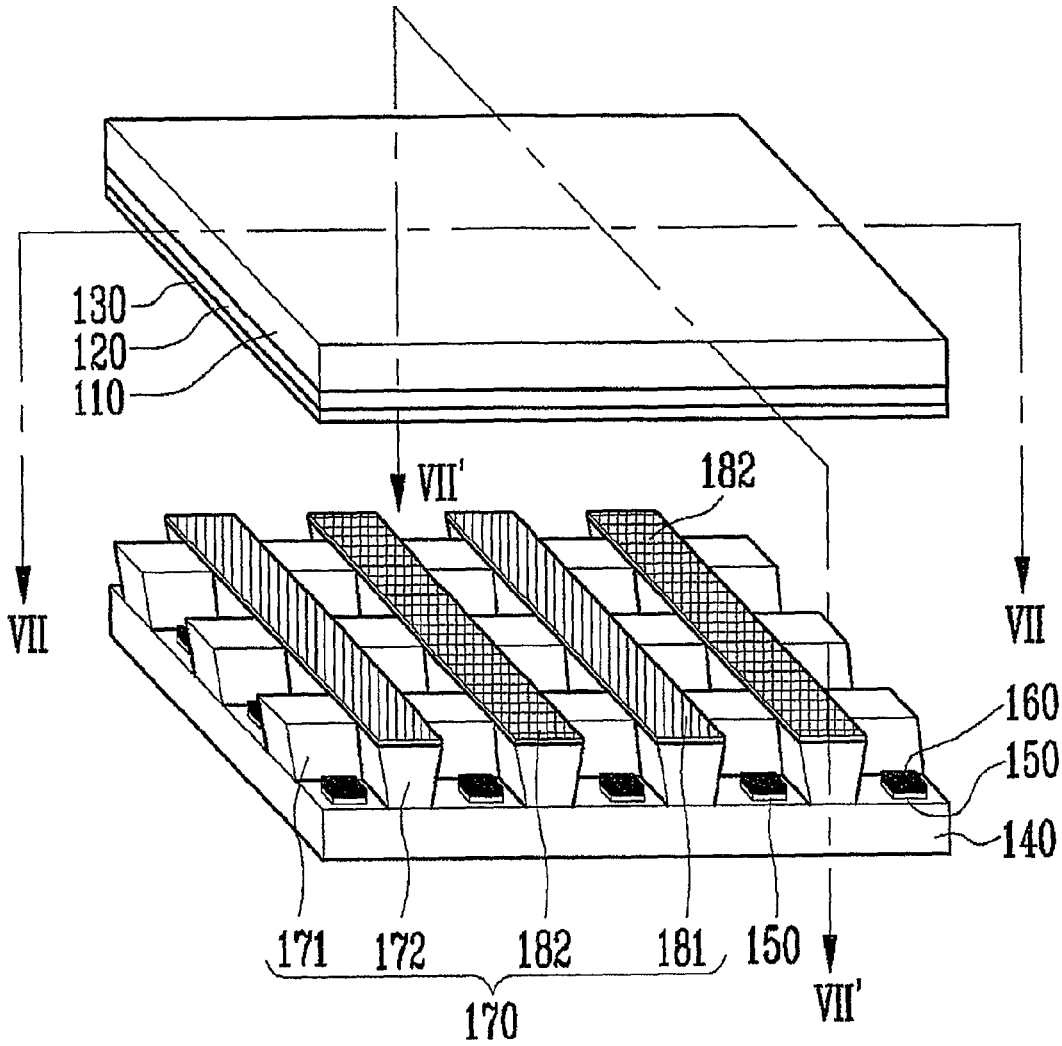

[Fig 6]
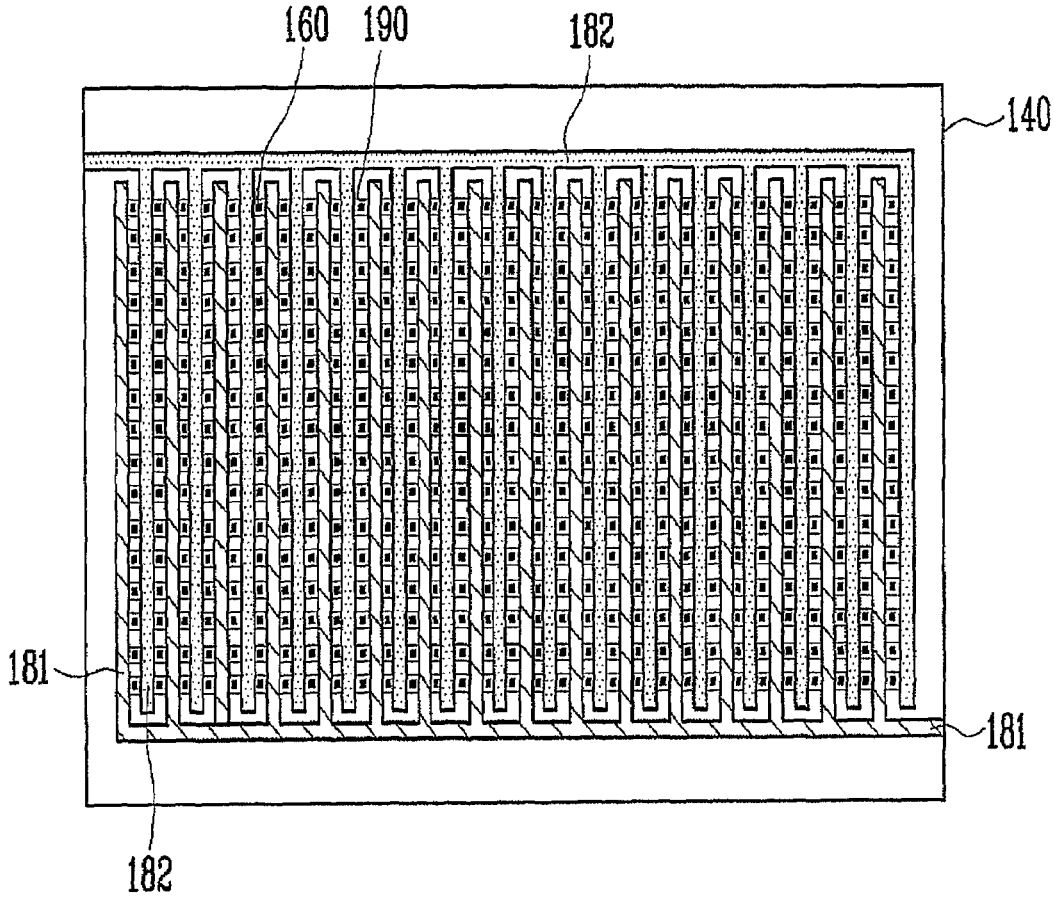

[Fig 7]
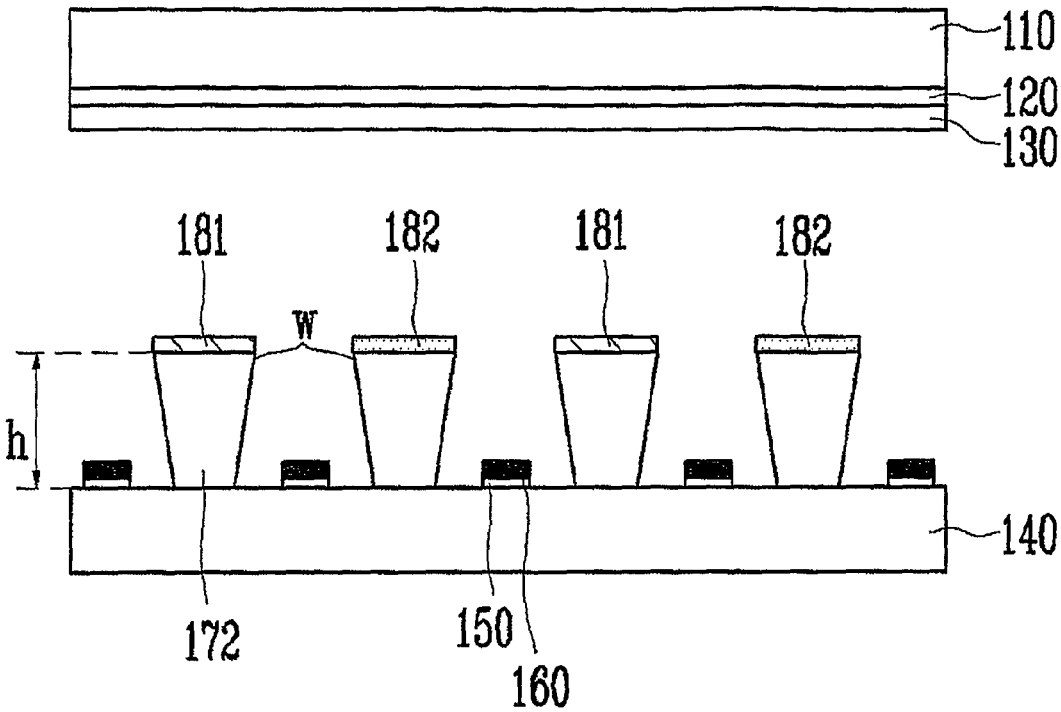

[Fig 8]
(a)
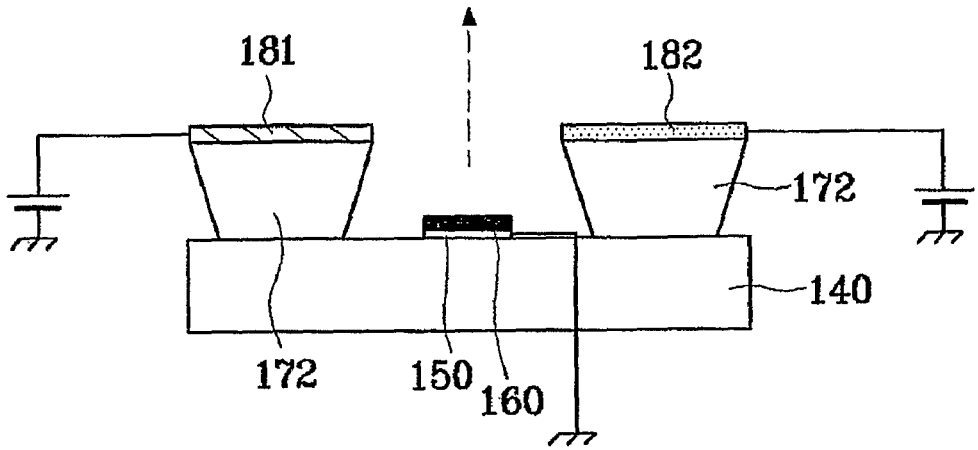
(b)
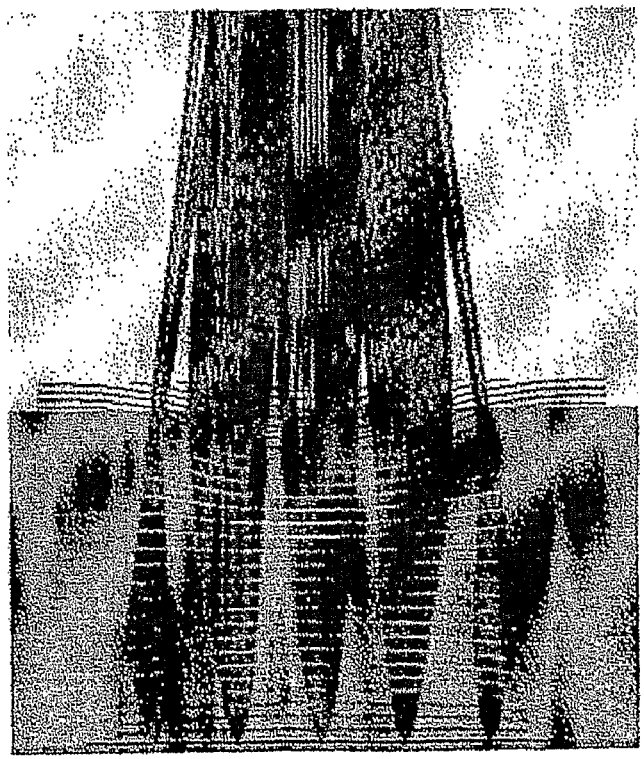

[Fig 9]
(a)
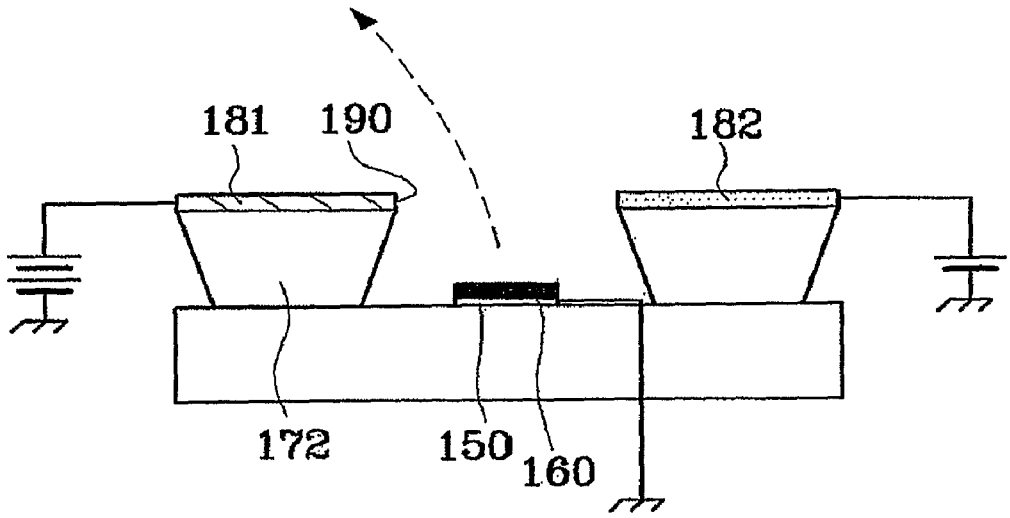
(b)
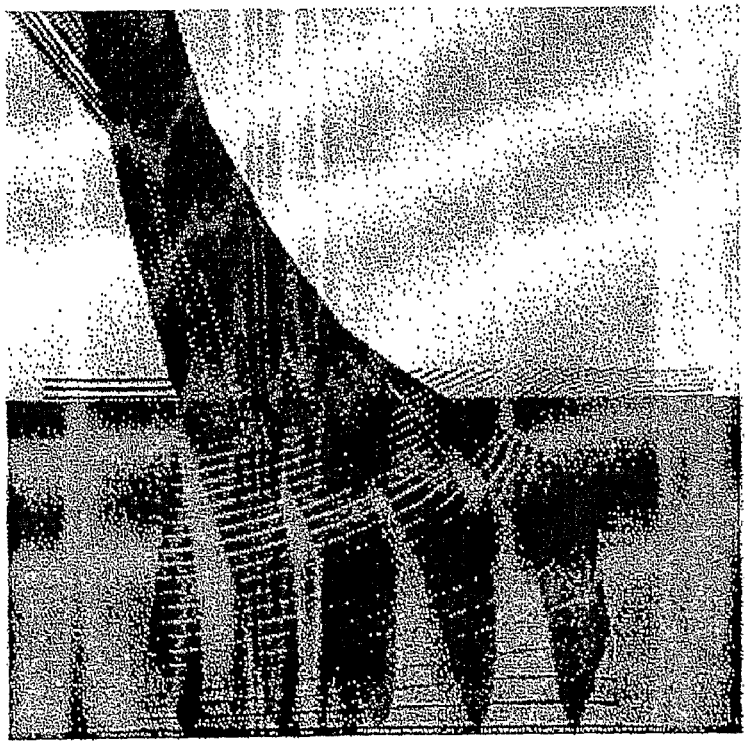

[Fig 10]
(a)
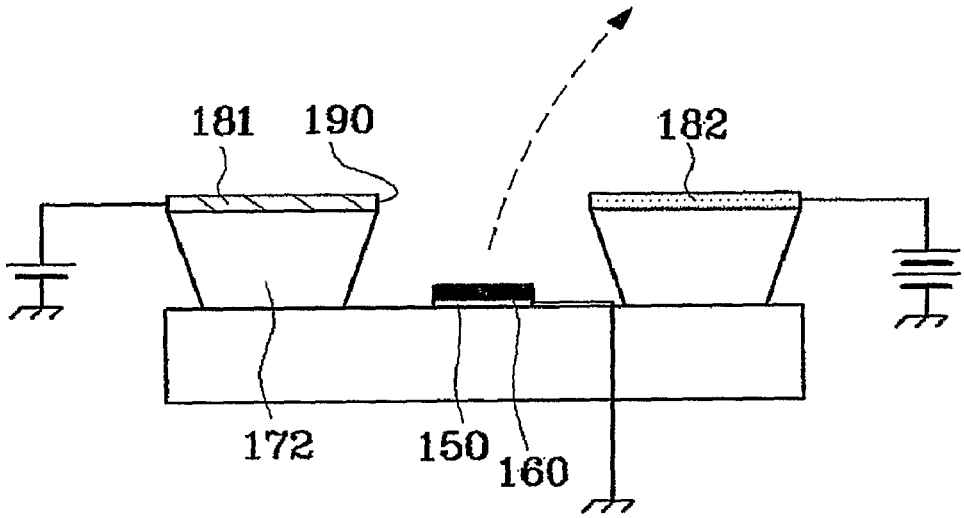
(b)
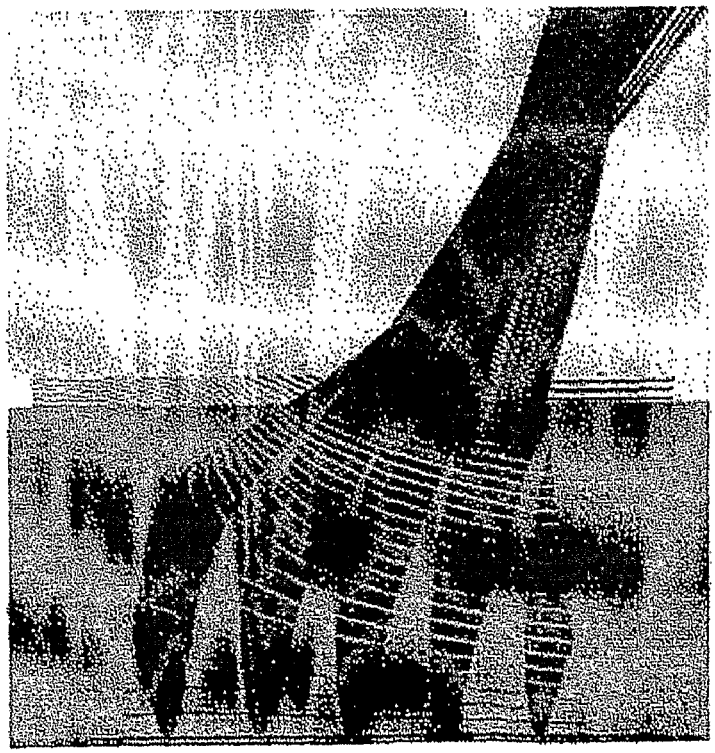

[Fig 11]
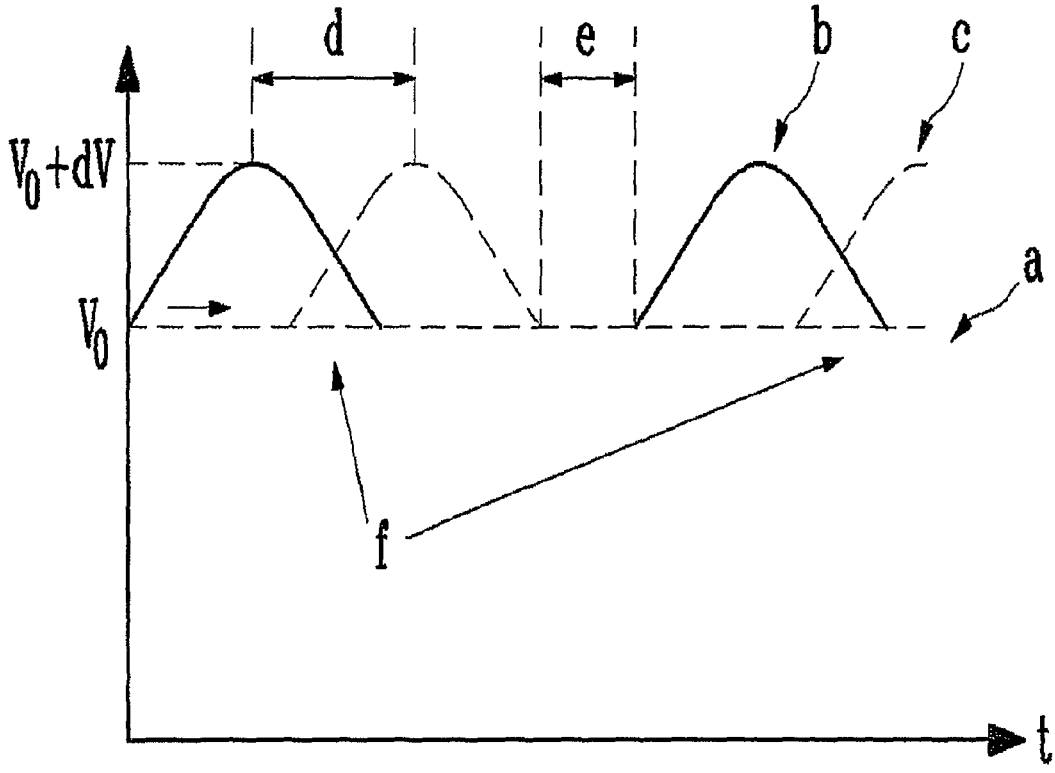

[Fig 12]
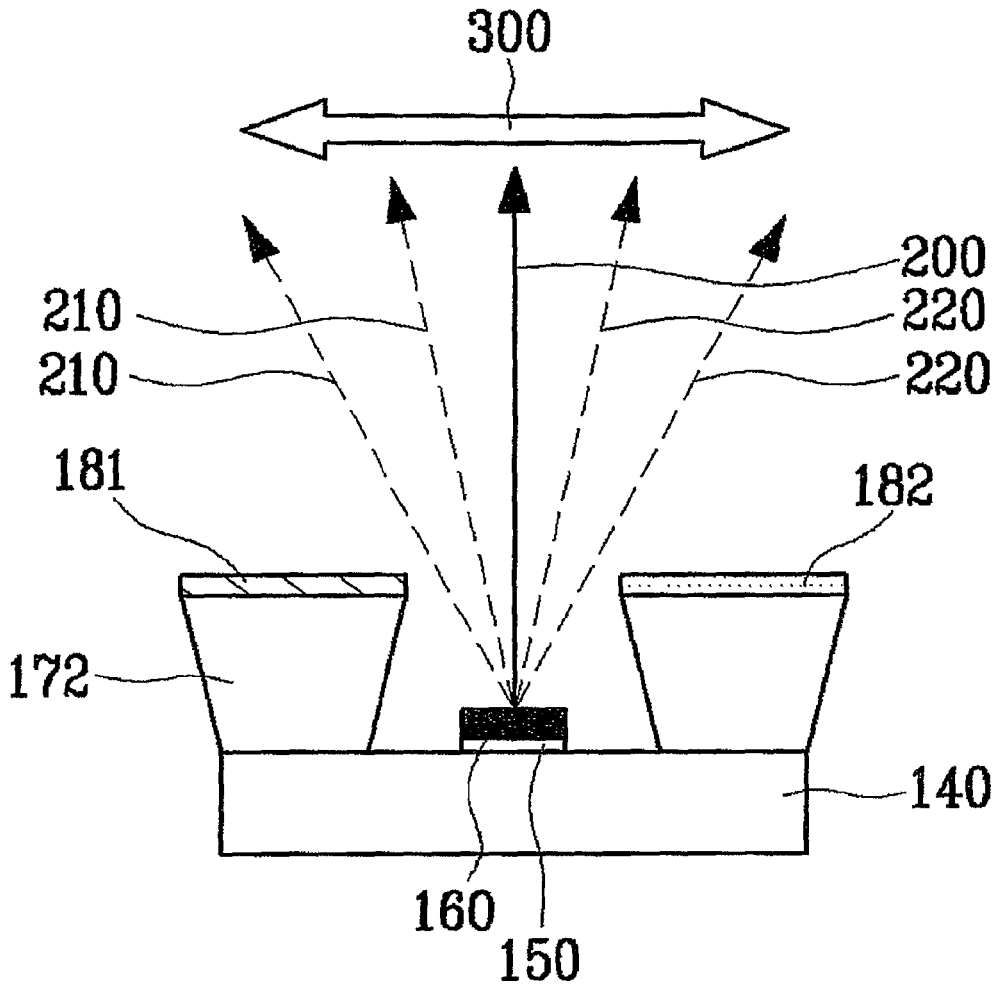

[Fig 13]
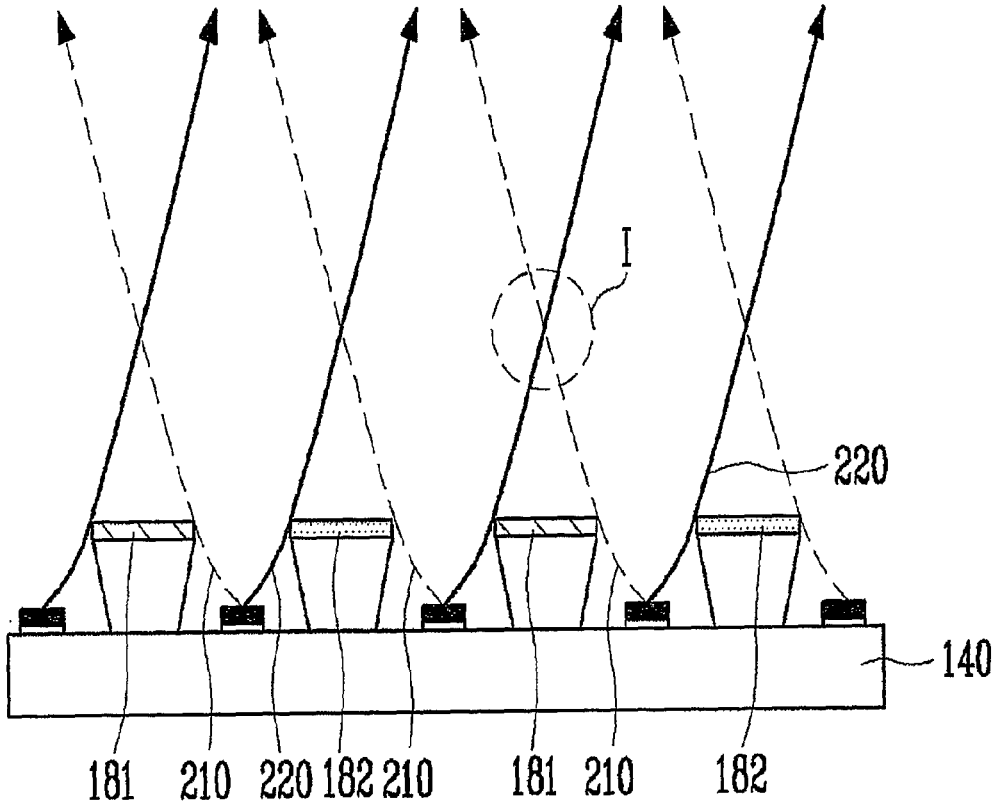

[Fig 14]
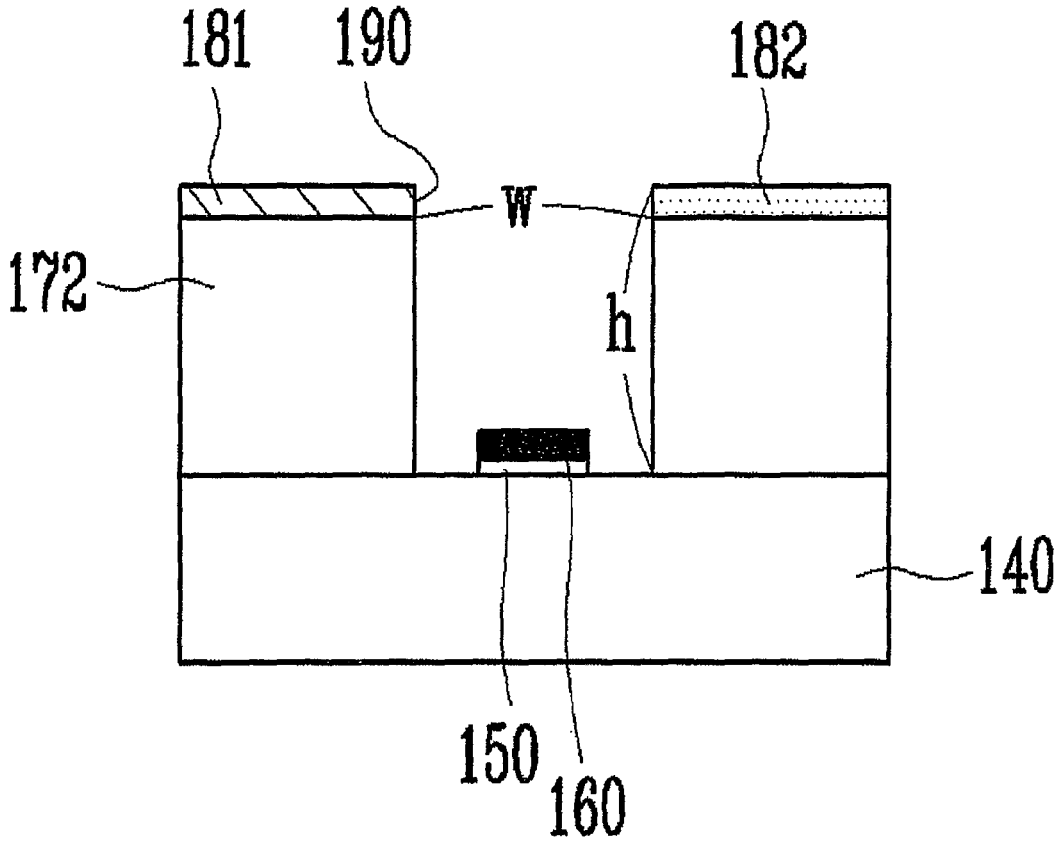

[Fig 15]
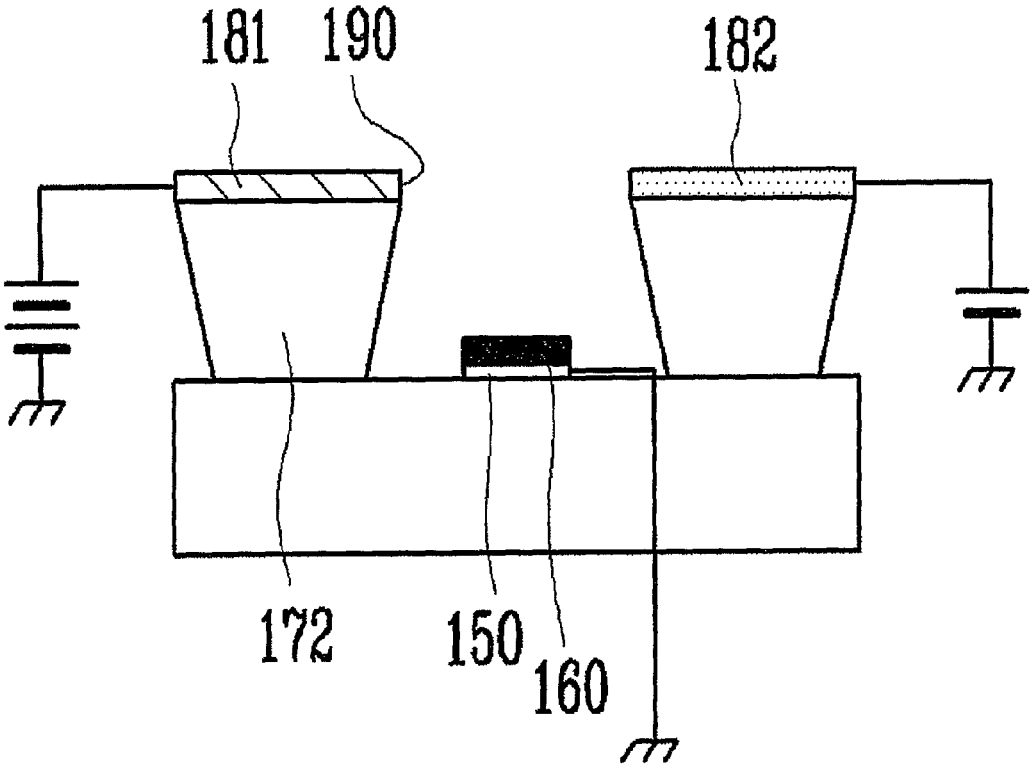

[Fig 16]
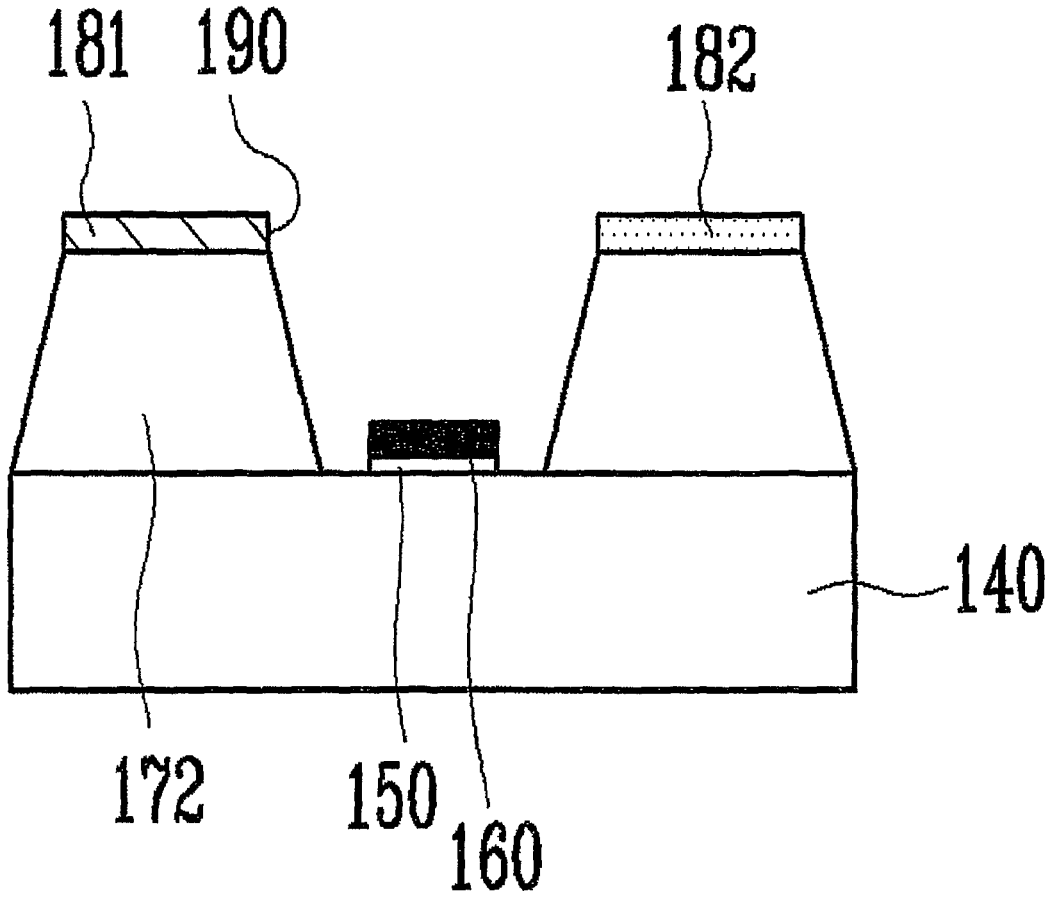

[Fig 17]
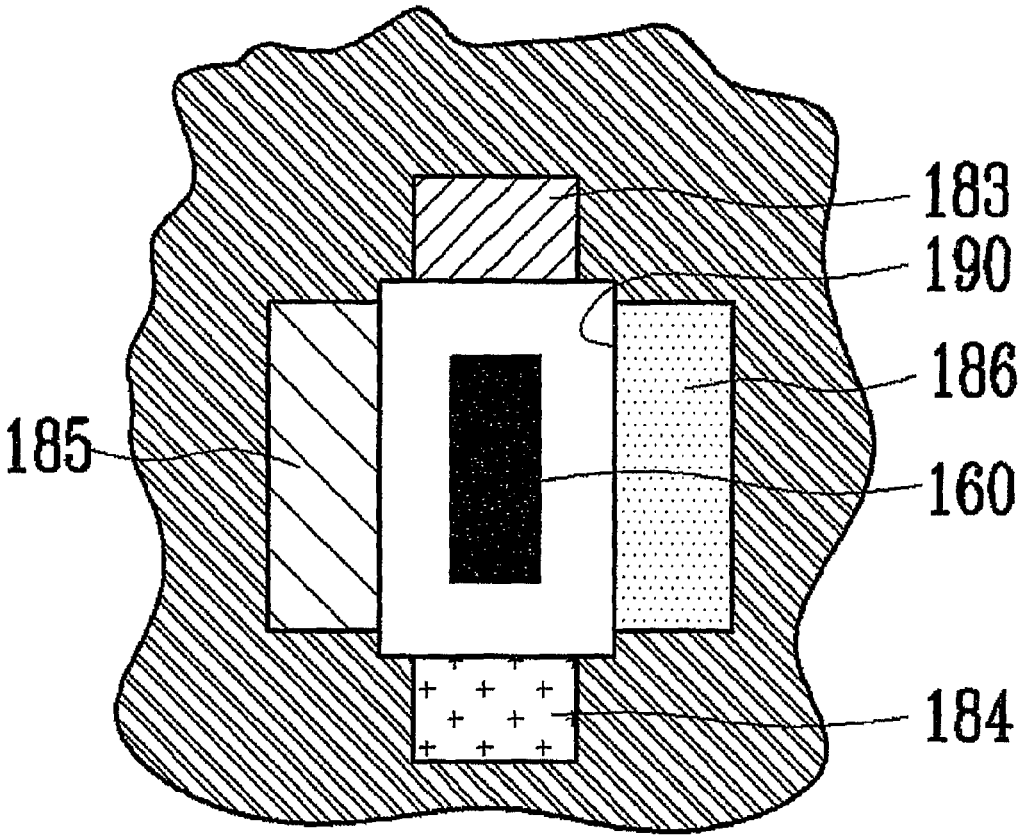

[Fig 18]
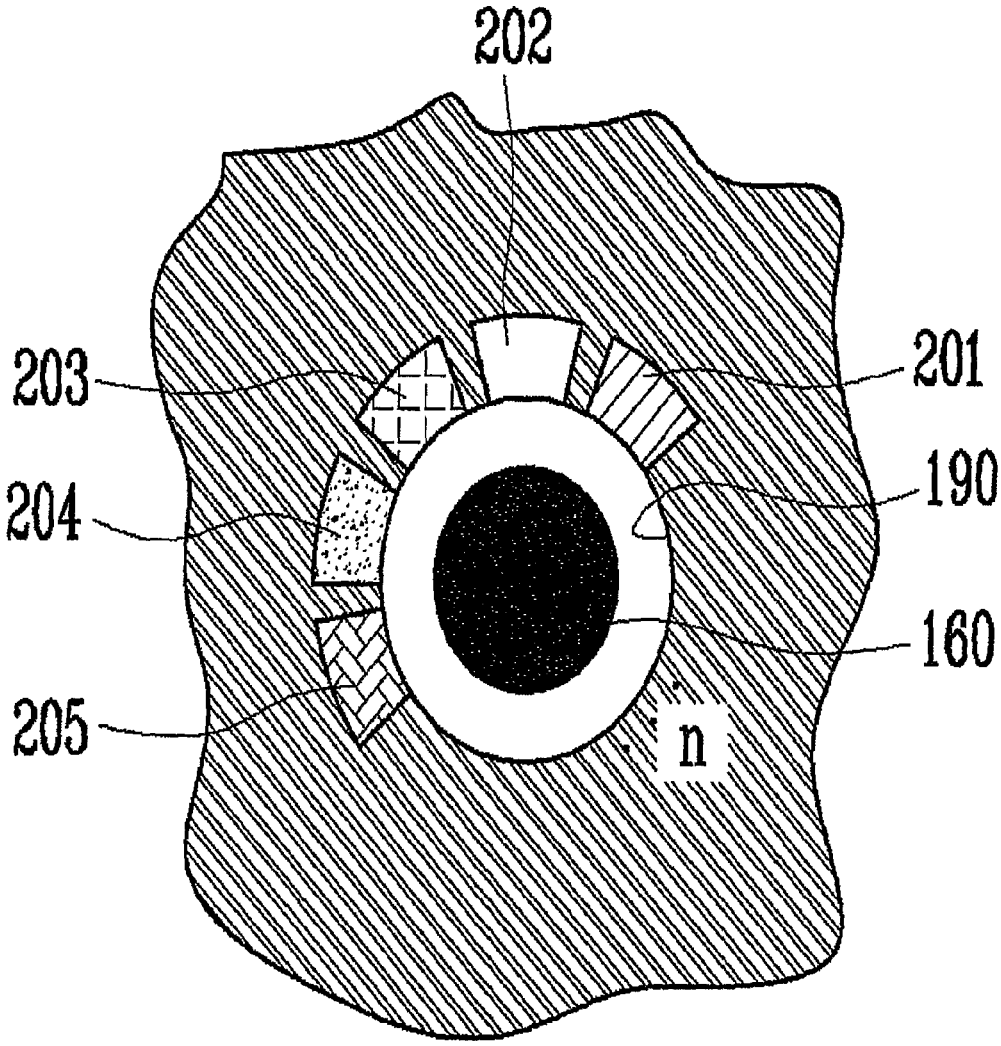

[Fig 19]
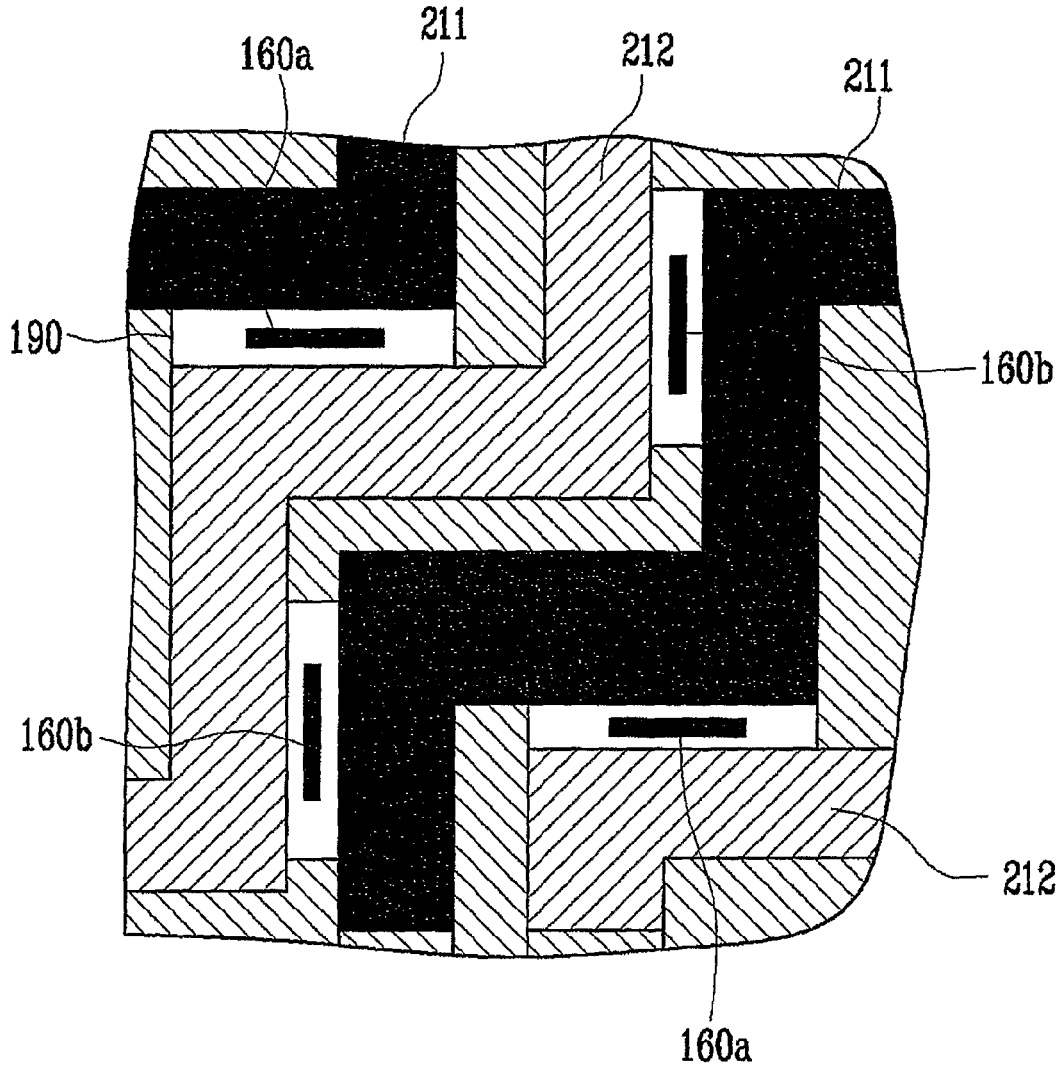

FIELD EMISSION DEVICE

TECHNICAL FIELD

The present invention relates to a field emission device, and more particularly, to a field emission device capable of attaining a high efficiency emission characteristic using a field emission lamp having a structure in which a plurality of gate electrodes are electrically isolated.

BACKGROUND ART

In general, a field emission device emits light using cathodoluminescence in a fluorescent layer on an anode substrate by causing electrons emitted from a field emitter on a cathode substrate to collide with the fluorescent layer. Here, the cathode substrate is disposed opposite to and spaced apart from the anode substrate by a specific distance, and the substrates are vacuum-packaged. Recently, a field emission lamp has been studied and developed as an alternative to a backlight unit for a conventional liquid crystal display (LCD), a flat light device, and a typical illumination device. In particular, the backlight unit generally includes a cold cathode fluorescent lamp (CCFL) or a light emitting diode. The CCFL backlight unit has advantages and disadvantages. The disadvantages include high manufacturing cost, environmental pollution, and nonuniform emission in, for example, a large display device.

To solve the problems, a field emission backlight unit with a relatively simple structure has been suggested. The field emission backlight unit has advantages of low manufacturing cost, mercury-free environmentally-friendly configuration, and low power consumption in comparison with a cold cathode fluorescent lamp.

As one sort of a field emission device, a conventional field emission backlight unit may be variously classified into, for example, those shown in FIGS. 1, 2 and 3.

FIG. 1 illustrates a diode-type field emission device.

Referring to FIG. 1, the diode-type field emission device, e.g., a field emission backlight unit includes an anode substrate 110, and a cathode substrate 140 disposed opposite to and spaced apart from the anode substrate 110 by a predetermined distance. An anode electrode 120 and a phosphor layer 130 are formed on the anode substrate 110 toward the cathode substrate 140. A cathode electrode 150 and a field emitter 160 are formed on the cathode substrate 140 toward the anode substrate 110.

In the field emission backlight unit having the above configuration, the field emitter 160 (e.g., carbon nanotube; CNT), which is formed on the cathode electrode 150 on the cathode substrate 140, emits elections. The electrons are induced and accelerated by a voltage applied to the anode electrode 120 on the anode substrate 110, which is disposed opposite to the cathode substrate 140 at a certain interval. A beam of electrons emitted from the field emitter 160 collides with the fluorescent layer 130 formed on the anode electrode 120, which absorbs energy of the electrons to emit a visible ray.

The diode-type field emission backlight unit can be easily manufactured because of its simple structure. However, arc discharge occurring in a free space between the cathode substrate 140 and the anode substrate 110 makes it difficult to apply a high voltage to the anode electrode 120, thus degrading fluorescence efficiency. In addition, it degrades uniformity of the electron beam emitted from the field emitter 160. Accordingly, it is difficult to attain uniform emission over the surface of the substrate including the fluorescent layer 130.

FIG. 2 illustrates a triode-type field emission device. Referring to FIG. 2, the triode-type field emission device, e.g., a field emission backlight unit includes an anode substrate 110 having an anode electrode 120 and a fluorescent layer 130, and a cathode substrate 140. A cathode electrode 150 is formed on the cathode substrate 140, and a plurality of insulators 169 are formed on the cathode substrate 140, with the cathode electrode 150 interposed between insulators 169. A field emitter 160 is formed on the cathode electrode 150, a gate electrode 180 is formed on each insulator 169, and an opening 190 exposing the field emitter 160 is formed between the gate electrodes 180.

In the above structure, electrons are induced and emitted from the field emitter 160 by a voltage applied to the gate electrode 180, which is electrically isolated from the cathode electrode 150 by the insulators 169. The emitted electrons are accelerated by a voltage applied to the anode electrode 120 to collide with the fluorescent layer 130. In principle, an amount of the electrons emitted by the field emitter 160 must depend on the cathode electrode 150 and the voltage applied to the anode electrode 120 should contribute only to the acceleration of the emitted electrons. However, since the insulators 169 are generally thinner than the opening 190 formed between the insulators 169 by a thin film process, the gate electrode 180 does not entirely block an electric field formed by the anode electrode 120. Accordingly, it is difficult to attain complete triode operation and apply a high anode voltage, as in the diode type.

FIG. 3 illustrates a lateral triode-type field emission device. Referring to FIG. 3, the triode-type field emission device, e.g., a field emission backlight unit includes an anode substrate 110 having an anode electrode 120 and a fluorescent layer 130, and a cathode substrate 140. A cathode electrode 150 and a gate electrode 180 are formed on the cathode substrate 140 and disposed adjacent to each other. Field emitters 160 are formed on the cathode electrode 150 and the gate electrode 180, respectively. The cathode electrode 150 or the gate electrode 180 function as a cathode electrode or a gate electrode according to a voltage difference between the two electrodes 150 and 180. Electrons emitted from the field emitters 160, which are formed on one surface of each of the electrodes 150 and 180, are accelerated by the anode electrode 120 to collide with the fluorescent layer 130. This lateral triode-type structure can be easily manufactured in comparison with the typical triode-type structure shown in FIG. 2 and driven by an AC signal, thereby improving an emission characteristic, but is fundamentally susceptible to a high anode voltage.

In general, a fluorescent substance used in a high-voltage cathode ray tube (CRT), when colliding with electrons accelerated by a high voltage, exhibits a proper emission characteristic. According to conventional knowledge, a phosphor exhibiting a good characteristic in a low-voltage condition does not exist. Accordingly, to obtain a proper characteristic of a high-voltage phosphor, a sufficiently high voltage needs to be applied to the anode electrode 120. However, in the case of the typical triode-type field emission backlight unit of FIG. 2, the gate insulators 169 are thinner than the opening 190, and when a higher anode voltage is applied, the field emitter 160 is damaged by arc discharge and a perfect triode operation is not attained so that electron emission does not depend on only the gate voltage but also the anode voltage.

FIGS. 4*a* and 4*b* are plan views of the typical triode-type field emission device of FIG. 2. Referring to FIGS. 4*a* and 4*b*, the gate electrode 180 having a different opening 190 surrounds the field emitter 160. In this case, the electron beam emitted by the voltage applied to the gate electrode 180 is directly induced toward the anode electrode 120 (see FIG. 2). To fill a space between the adjacent field emitters 160 that the electron beam does not reach, the number of unit openings 190 formed for electron beam emission or the distance between the anode substrate 110 and the cathode substrate 140 must increase to spread the electron beam. However, the increased number of the openings 190 or the field emitters 160 makes it difficult to attain process yield and uniform arrangement of the emitters. Furthermore, because the distance between the anode substrate 110 and the cathode substrate 140 cannot increase indefinitely due to structural limitations, it is difficult to obtain a highly uniform emission characteristic.

DISCLOSURE OF INVENTION

Technical Problem

The present invention is directed to a field emission device in which the trajectory and area of an electron beam are adjusted using a plurality of electrically isolated gate electrodes.

Also, the present invention is directed to a field emission device in which effects of arc discharge at a high anode voltage can be minimized by allowing the sum of heights of a gate insulator and a gate electrode to be greater than a diameter of an opening formed in a gate substrate (exposing a field emitter) or an interval between the gate electrodes.

Technical Solution

One aspect of the present invention provides a field emission device comprising: an anode substrate including an anode electrode formed on a surface thereof and a phosphor layer formed on the anode electrode; a cathode substrate disposed opposite to and spaced apart from the anode substrate, and including at least one cathode electrode formed toward the anode substrate and a field emitter formed on each cathode electrode; and a gate substrate having one surface in contact with the cathode substrate, wherein the gate substrate include gate insulators surrounding the field emitters and having a plurality of openings exposing the field emitters, and a plurality of gate electrodes formed on the gate insulators around the openings and electrically isolated from one another.

The gate electrodes may comprise first gate electrodes and second gate electrodes electrically isolated from one another and alternately formed on the gate insulators. Different electric fields or the same electric field may be applied to the gate electrodes. The gate substrate including the gate insulators and the gate electrodes may have a height greater than a diameter of the gate hole opening. The height of the gate substrate may be 0.5 to 10 times greater than the minimum diameter of the opening.

The gate insulator and the opening exposing the field emitter may have a cross section in a rectangular, trapezoid, or reverse trapezoid shape. The gate substrate may be separately made and then attached to the cathode substrate. Each field emitter may have an area smaller than that of each opening. The gate insulator may be directly formed on the cathode substrate, and then the gate electrode may be formed on the insulator substrate. The field emitter may be formed of one of a carbon nanotube, a carbon nanofiber, and a carbon-based synthetic material.

A trajectory of an electron beam emitted from the field emitter may be adjusted by changing voltages applied to the gate electrodes into a sine wave form over time. When the voltages are applied to all the gate electrodes, phases of the sine waves may be adjusted so that the sum of the gate voltages applied to the field emitter is identical to a peak voltage of the gate electrode. The voltages may comprise rest periods, in which they are not applied to the gate electrodes, for pulse driving.

Advantageous Effects

By the above method, when trajectories of the electron beams emitted from the emitters are rapidly changed over time by a voltage difference between the gate electrodes, an electron beam-scanned area can be expanded due to residual images and the electron beam can be more uniformly emitted due to an electron beam scattering effect and a linear beam spreading effect, resulting in improved emission uniformity of the phosphor layer. By using the insulator in which the height from the emitter to the gate electrode is greater than the diameter of the gate opening, a high voltage can be applied to the anode substrate, thereby attaining high efficiency emission.

BRIEF DESCRIPTION OF THE DRAWINGS

FIG. 1 is a cross-sectional view of a diode-type field emission device;

FIG. 2 is a cross-sectional view of a triode-type field emission device;

FIG. 3 is a cross-sectional view of a lateral triode-type field emission device;

FIGS. 4*a* and 4*b* are plan views illustrating another example of the triode-type field emission device of FIG. 2;

FIG. 5 is a partially enlarged perspective view schematically illustrating a field emission device according to an exemplary embodiment of the present invention;

FIG. 6 is an enlarged plan view of an area of a cathode substrate of FIG. 5;

FIG. 7 is a cross-sectional view taken along line VII-VII of FIG. 5;

FIGS. 8*a*, 9*a* and 10*a* and 8*b*, 9*b* and 10*b* are views respectively illustrating the unit structures of a cathode substrate having two gate electrodes and the simulation results of an electron beam trajectory dependent on a voltage difference between the two gate electrodes according to the present invention;

FIG. 11 is a time-voltage graph illustrating an example of gate voltage application in a structure having two gate electrodes according to an exemplary embodiment of the present invention;

FIG. 12 is a view illustrating trajectories of electron beams according to a voltage difference between the two gate electrodes of FIG. 11;

FIG. 13 is a view illustrating spread of electron beams depending on a change in voltage between gate electrodes according to an exemplary embodiment of the present invention;

FIGS. 14 to 16 are partially enlarged cross-sectional views of field emission devices according to other exemplary embodiments of the present invention; and FIGS. 17, 18 and 19 are partially enlarged plan views of field emission devices according to exemplary embodiments of the present invention.

DESCRIPTION OF MAJOR SYMBOLS IN THE ABOVE FIGURES

110: Anode substrate
120: Anode electrode

130: Phosphor layer
140: Cathode substrate
150: Cathode electrode
160: Field emitter
170: Gate substrate
169, 171, 172: Insulator
180: Gate electrode
181: First gate electrode
182: Second gate electrode
190: Opening
200, 210, 220: Trajectories of electron beams
h: Insulator height
W: Distance between gate electrodes
I: Overlapping trajectory area
183, 184: Gate electrode
201, 202, 203, 204, 205, 211, 212: Gate electrode
160*a*, 160*b*: Field emitter

MODE FOR THE INVENTION

Hereinafter, exemplary embodiments of the present invention will be described in detail. In the present exemplary embodiment, a gate insulator has a height greater than that of a gate electrode to form a gate substrate having a height greater than a diameter of an opening. However, to increase the height of the gate substrate, the gate electrode may have a greater thickness. In this manner, the height of the gate substrate may increase by increasing either the height of the gate insulator or the height of the gate electrode.

FIG. 5 is a partially enlarged perspective view schematically illustrating a field emission device according to an exemplary embodiment of the present invention, FIG. 6 is an enlarged plan view of an area of a cathode substrate of FIG. 5, and FIG. 7 is a cross-sectional view taken along line VII-VII of FIG. 5.

Referring to FIGS. 5 to 7, the present field emission device, i.e., a field emission backlight unit includes an anode substrate 110, a cathode substrate 140 disposed opposite to and spaced apart from the anode substrate 110, and a gate substrate 170 formed between the anode substrate 110 and the cathode substrate 140. An anode electrode 120 and a phosphor layer 130 are formed on the anode substrate 110 toward the cathode substrate 140.

On the cathode substrate 140, a plurality of cathode electrodes 150 are formed at certain intervals toward the anode substrate 110, and a field emitter 160 is formed on each cathode electrode 150. The gate substrate 170 is formed on the cathode substrate 140. The gate substrate 170 includes insulators 171 and 172 formed between the field emitters 160 to isolate the field emitters 160, and gate electrodes 181 and 182 formed on the insulators 171 and 172. In the present exemplary embodiment, the insulators 171 and 172 cross one another in a matrix form. The gate electrodes 181 and 182 are electrically isolated and are formed on the insulator 172. In FIGS. 5 and 6, the first gate electrodes 181 and the second gate electrodes 182 are formed. The linear first and second gate electrodes 181 and 182 are connected in parallel as shown in FIG. 6. The first gate electrodes 181 and the second gate electrodes 182 are formed in an alternating manner. The gate openings 190 and the field emitters 160 are located between the first gate electrode 181 and the second gate electrode 182, as shown in FIG. 6, so that an electron beam is induced by voltages applied to the electrodes 120, 150, 181, and 182, and a trajectory of the electron beam is adjusted. Referring to FIG. 7, the height h of the insulator 172 is greater than an interval w between the insulators 172 (i.e., an opening 190 exposing the field emitter 160). The heights of the gate insulator and the gate electrode are the same as or different from each other.

Meanwhile, the gate substrate 170 including the gate insulators 172 and 171 and the gate electrodes 181 and 182 is separately made and then attached to the cathode substrate 140. Alternatively, the gate substrate 170 may be formed by directly forming the gate insulators 171 and 172 on the cathode substrate 140 using, for example, screen printing and then forming metal films (i.e., gate electrodes) on the gate insulators 171 and 172. In the case where the gate substrate 170 is separately made and then attached to the cathode substrate 140, the gate substrate 170 is formed by forming the opening 190 in glass, ceramic or insulator substrates 171 and 172 and depositing an electrode thereon, or by making a metal plate and attaching an insulator beneath the metal plate, and then the gate substrate 170 is attached to the cathode substrate 140 having the field emitters 160. To allow the height of the gate electrode to be greater than the opening diameter, in the former, the height of the insulator is adjusted and, in the latter, the height of the gate electrode is adjusted.

FIGS. 8*a*, 9*a* and 10*a* and 8*b*, 9*b* and 10*b* are views respectively illustrating the unit structures of a cathode substrate having two gate electrodes and the simulation results of an electron beam trajectory dependent on a voltage difference between the two gate electrodes according to the present invention.

Referring to FIGS. 8*a* and 8*b*, when the same voltage is applied to two gate electrodes 181 and 182, electrons are emitted from a center of a field emitter 160 in a direction perpendicular to surfaces of the gate electrodes 181 and 182, as in a typical single-gate electrode structure. That is, when the voltages applied to the gate electrodes 181 and 182 are the same, the distribution of an electric field is balanced as shown in FIG. 8*b*, so that the electron beam emitted from the field emitter 160 is directly induced toward the anode substrate 110.

Referring to FIGS. 9*a* and 9*b*, when different voltages are applied to two electrodes 181 and 182, and in particular, when a higher voltage is applied to the first gate electrode 181, an electric field distribution is deflected toward the first gate electrode 181. Referring to FIGS. 10*a* and 10*b*, when a higher voltage is applied to a second gate electrode 182, an electric field distribution is deflected toward the second gate electrode 182.

As stated above, when one of the gate electrode voltages is higher than the other, a movement trajectory of the electrons emitted from the field emitter 160 is bent toward the electrode to which the higher voltage is applied, as shown in FIGS. 9*a* and 10*a*. It can be seen from the electron beam simulation result shown in FIG. 9*b* that when the voltage applied to the left, i.e., the first gate electrode 181, is higher than that applied to the second gate electrode 182, the electron beam is deflected to the left until it arrives at the anode substrate 110. As shown in FIG. 10*b*, when the voltage applied to the right, i.e., the second gate electrode 182, is higher than that applied to the first gate electrode 181, the electron beam is deflected to the right until it arrives at the anode substrate 110. As a result, the distribution of the electric field from the field emitter 160 is deflected according to the voltages applied to the first and second gate electrodes 181 and 182, which affects the electron beam trajectory.

FIG. 11 is a time-voltage graph illustrating an example of gate voltage application in a structure having two gate electrodes according to an exemplary embodiment of the present invention. In FIG. 11, a horizontal axis represents time and a vertical axis represents voltage.

Minimum offset voltages, which can cause electron emission from the field emitter 160, are applied to the first gate electrode 181 and the second gate electrode 182 (as indicated by a), and the voltages of the first gate electrode 181 and the second gate electrode 182 vary with time periodically and alternately (as indicated by b and c). In this case, there is a phase difference d between the voltages applied to the first gate electrode 181 and the second gate electrode 182, and the sum of the two electrode voltages is made equal to a peak value ($V_0$+dV) of each electrode voltage at a time f when the two electrode voltages are applied. Ideally, the respective voltage waveforms have only one half of a sine wave in one cycle and a phase difference of $\pi/2$. For pulse driving, between the voltage waveforms, there is a period of time (e) in which the voltage is not applied to the gate electrode.

FIG. 12 is a view illustrating trajectories of electron beams according to a voltage difference between the two gate electrodes of FIG. 11. The electron beams emitted from the field emitter 160 move along trajectories 210 when the voltage applied to the first gate electrode 181 is higher, trajectories 220 when the voltage applied to the second gate electrode 182 is higher, and a trajectory 200 when the voltages applied to two electrodes 181 and 182 are the same. Rapidly and repeatedly applying such voltages causes residual images, resulting in expansion of the electron beam trajectory to an area indicated by 300.

FIG. 13 is a view illustrating spread of electron beams depending on a change in voltage between gate electrodes according to an exemplary embodiment of the present invention. Referring to FIG. 13, the electron beam can spread using a change in voltage between the gate electrodes, thereby allowing the field emitters 160 to be disposed at greater spaces. Thus, the cathode substrate 140 can be easily manufactured and the anode substrate 110 and the cathode substrate 140 can be disposed at a smaller spacing, resulting in a smaller thickness of the device. Further, when the electron beam is induced by the gate electrodes 181 and 182 located between the field emitters 160, and overlaps the electron beam emitted from the adjacent field emitter 160 as indicated by I in FIG. 13, the dense electron beams are scattered by an electron beam scattering effect, resulting in increased uniformity of the electron beam.

In the above exemplary embodiment, adjusting the electron beam trajectory and improving the uniformity using the gate electrodes 181 and 182 are associated with the cross-section taken along line VII-VII shown in FIG. 5. However, in a direction perpendicular to line VII-VII shown in FIG. 5, i.e., a longitudinal section taken along line VII'-VII', the shape of the emitter and the location of the two gate electrodes relative to the emitter can be properly adjusted for electron beam radiation. An example thereof is shown in FIG. 19.

FIGS. 14 to 16 are partially enlarged cross-sectional views according to other exemplary embodiments of the present invention. Referring to FIG. 14, in the present exemplary embodiment, a height h from the surface of the field emitter 160 to the gate electrodes 181 and 182 is relatively greater than a diameter w of the opening 190 between the gate electrodes 181 and 182. Preferably, the height h is 0.5 to 10 times greater than the distance between the gate electrodes 181 and 182. In particular, when the opening is not in a circular shape but in an asymmetrical shape, the height extending to the gate electrodes 181 and 182 is more greatly affected by a narrow interval of the opening 190. For example, when the opening 190 is in a rectangular shape, the height extending to the gate electrode may be determined by a short-side length of the rectangle.

The gate substrate having a relatively greater height than the diameter of the opening can be attained by increasing the height of the gate insulator 172 or the gate electrodes 181 and 182. To increase the height of the gate insulator 172, an insulator having a plate form fabricated by processing a glass or ceramic plate, or by a thick film process such as screen printing, may be coated with a conductive thin film. To increase the height of the gate electrode, an opening may be first formed in a metal plate and then a gate insulating layer may be formed on one surface of the metal plate.

When the height of the gate insulator 172 is greater than the diameter of the opening 190, i.e., when the height h is greater than the distance w between the gate electrodes 181 and 182, an external electric field, i.e., the anode voltage or arc discharge-induced electric field, is blocked by the voltages applied to the gate electrodes 181 and 182, so that a high voltage can be stably applied to the anode electrode. Further, an area of the field emitter 160 is smaller than that of the opening 190, as shown in FIG. 14.

While the insulator 172 of FIG. 14 is in a rectangular shape, insulators 172 of FIGS. 15 and 16 are slightly changed from a rectangle. Referring to FIGS. 15 and 16, an opening diameter at the side of the gate electrodes 181 and 182 is smaller or greater than that at the side of the lower area of the insulator 172 so that sidewalls of the opening are slanted. The gate insulator slanted as shown in FIG. 15 blocks the opening sidewalls from being coated with a conductive metal when the electrode is coated, thus improving an insulating characteristic. The gate insulator formed in a trapezoid form as shown in FIG. 16 can minimize electron beam collision with the sidewalls of the insulator 172 and increase an amount of the emitted electron beam and a spreading angle.

In the above exemplary embodiments, the device has been described as having two gate electrodes. However, the device may have four gate electrodes 183, 184, 185 and 186 formed around a gate opening 190 as shown in FIG. 17, or a plurality of gate electrodes 201, 202, 203, 204, 205, . . . around a gate opening 190 as shown in FIG. 18, to adjust a trajectory of an electron beam coming out of the opening 190. The electrodes shown in FIGS. 17 and 18 are electrically isolated from each other. Accordingly, different voltages can be applied to the electrodes, and the shape of the gate opening 190 and the location and shape of the electrodes around the opening can be changed. FIG. 19 shows a basic unit for field emitters and gate electrodes that are formed in a repeated pattern. Gate electrodes 211 and 212 are electrically isolated from each other as described above. Accordingly, when different voltages are applied to the gate electrodes, the trajectories of electron beams from two field emitters 160*a* spread upward and downward and the trajectories of electron beams from the two other field emitters 160*b* spread left and right, resulting in uniform spread of the electron beam in all directions, unlike the above-described exemplary embodiments.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A field emission device comprising:

an anode substrate including an anode electrode formed on a surface thereof and a fluorescent layer formed on the anode electrode;

a cathode substrate disposed opposite to and spaced apart from the anode substrate, and including at least one cathode electrode formed toward the anode substrate and a field emitter formed on each cathode electrode; and a gate substrate having one surface in contact with the cathode substrate, wherein the gate substrate include gate insulators surrounding the field emitters and having a plurality of openings exposing the field emitters, and a plurality of gate electrodes formed on the gate insulators around the openings and electrically isolated from one another.

2. The device according to claim 1, wherein the gate electrodes comprise first gate electrodes and second gate electrodes alternately formed on the gate insulators.

3. The device according to claim 2, wherein different electric fields or the same electric field are applied to the gate electrodes.

4. The device according to claim 1, wherein the gate substrate including the gate insulators and the gate electrodes has a height greater than a diameter of the opening.

5. The device according to claim 4, wherein the height of the gate substrate is 0.5 to 10 times greater than the opening diameter.

6. The device according to claim 1, wherein the gate insulator or the opening has a cross section in a rectangular, trapezoid, or reverse trapezoid shape.

7. The device according to claim 1, wherein the gate substrate is separately made and then attached to the cathode substrate.

8. The device according to claim 1, wherein each field emitter has an area smaller than that of each opening.

9. The device according to claim 1, wherein the gate insulator is directly formed on the cathode substrate, and then the gate electrode is formed on the gate insulator.

10. The device according to claim 1, wherein the field emitter is formed of one of a carbon nanotube, a carbon nanofiber, and a carbon-based synthetic material.

11. The device according to claim 1, wherein a trajectory of an electron beam emitted from the field emitter is adjusted by changing voltages applied to the gate electrodes into a sine wave form over time.

12. The device according to claim 11, wherein when the voltages are applied to all the gate electrodes, phases of the sine waves are adjusted so that the sum of the gate voltages connected to the field emitter is identical to a peak voltage of the gate electrode.

13. The device according to claim 11, wherein the voltages comprise rest periods, in which they are not applied to the gate electrodes, for pulse driving.

14. The device according to claim 1, wherein the gate electrodes includes a first gate electrode and a second gate electrode that are disposed around a same opening, and the first and second gate electrodes are electrically isolated from each other, and separate voltages are applied respectively to the first gate electrode and the second gate electrode.

15. The device according to claim 14, wherein voltages of the first and second gate electrodes vary with time periodically.

16. The device according to claim 14, wherein a trajectory of an electron beam emitted from the field emitter moves toward the first gate electrode when the voltage applied to the first gate electrode is higher, and movers toward the second gate electrode when the voltage applied to the second gate electrode is higher.

17. The device according to claim 14, a height of the gate substrate is greater than a distance between the first gate electrode and the second gate electrode.

* * * * *